United States Patent [19]

Amos et al.

[11] 4,195,526

[45] Apr. 1, 1980

[54] HAND-HELD PIPETTER

[75] Inventors: Lynn G. Amos, Painted Post, N.Y.; Robert T. Buck, Raleigh, N.C.

[73] Assignee: Corning Glass Works, Corning, N.Y.

[21] Appl. No.: 876,340

[22] Filed: Feb. 9, 1978

[51] Int. Cl.[2] ..... B01L 3/02

[52] U.S. Cl. ..... 73/425.6

[58] Field of Search ..... 73/425.4 P, 425.6; 141/25; 222/215; 422/100

[56] References Cited

U.S. PATENT DOCUMENTS

| | | | |
|---|---|---|---|
| 2,866,340 | 12/1958 | Goldberg | 73/425.6 |
| 2,960,868 | 11/1960 | Price | 73/425.6 |
| 3,297,558 | 1/1967 | Hillquist | 73/425.6 |
| 3,502,095 | 3/1970 | Grensberg et al. | 73/425.6 |

*Primary Examiner*—S. Clement Swisher

*Attorney, Agent, or Firm*—Walter S. Zebrowski; Clarence R. Patty, Jr.; Richard E. Kurtz

[57] ABSTRACT

A pipetter for drawing fluid into capillary tubes and the like. A capillary tube is forced into an adapter coupled to one end of a vented, flexible tube. A compression wheel rides in a guideway adjacent the tube, and is rolled to continuously vary the point at which the tube is compressed in the manner of a peristaltic pump. Manual rolling of the wheel away from the capillary tube produces sufficient suction in the tube to cause liquid to be drawn into it. The pumping action is reversible in that rolling the wheel back toward the capillary tube will cause fluid to be expelled. Provision is made to prevent undesirable "compression set" as a result of long term static of the flexible tube during periods of non-use.

12 Claims, 6 Drawing Figures

HAND-HELD PIPETTER

BACKGROUND OF THE INVENTION

The present invention relates to pipetters, and more particularly to hand-held pipetters for controllably loading a volume of fluid into a sampling pipe or the like and conveniently dispensing the volume desired.

Pipetters are conventionally used to draw up samples of a liquid material so that it may be transported to another area, where it is discharged for analysis or other use. The earliest (and simplest) form of pipetter took the form of a simple glass tube; an operator would simply suck on the upper end of the tube in order to draw the sample material into its lower end. This technique is still in use; for instance, a sample pipe is connected to another tube having a mouthpiece, and an operator draws on the mouthpiece to lead liquid into the sample tube. This approach, though having the virtue of being simple, has several drawbacks. It is possible, for instance, for the operator to overdraw so that portions of the sample, or vapors of it, enter his mouth or lungs. Obviously this is an undesirable and potentially dangerous practice where the sample is of a toxic nature. Another problem which occurs with this approach is the difficulty experienced by operators is precisely controlling the loading and expulsion of a sample.

Another type of pipetter presently being used is the so-called "piston" type. A screw or geared assembly is coupled to a close fitting piston riding in a cylinder. By turning a screw, gear or knob an operator causes the piston to move within the cylinder, creating a low pressure which draws liquid into a sample pipe coupled to the cylinder. Such pipetting mechanisms have the disadvantage of being relatively complex, and therefore expensive. Still further the friction between the piston and cylinder, and the backlash in the mechanism, make it difficult to control the precise volume of sample being drawn. Beyond this, it has been found difficult to produce an air-tight seal of high integrity between the piston and surrounding cylinder, further complicating the problem of accurately controlling the volume of sample being drawn.

Accordingly, it will be appreciated that it would be highly advantageous to provide a pipetter which is relatively simple and inexpensive to manufacture, but which avoids the problems which inhere in the prior art apparatus and is susceptible of precise operator control.

It is therefore an object of the present invention to provide an improved hand-operated pipetter.

Another object of the invention is to provide a pipetter mechanism having little or no effective hysteresis.

Another object of the invention is to provide a pipetter of the peristaltic pumping type.

Yet another object is to provide a hand-held pipetter which is relatively simple and economical to manufacture.

SUMMARY OF THE INVENTION

Briefly stated, in accordance with one aspect of the invention the foregoing objects are achieved by providing an elongate housing having a support surface within it, and a guide extending generally parallel to the support surface. A resilient tube is disposed over the support surface, and an adapter coupled to one end of the tube for receiving a capillary tube or other sampling pipe. A compression wheel is disposed in the housing, and constrained by the guide. The wheel is dimensioned so that it extends from the guide to a point near the support surface, so that the tubing is pinched closed by the wheel. As the wheel is rolled the point of compression continuously varies in the manner of a peristaltic pump, drawing sample liquid into the pipe when the wheel is rolled away from the sample pipe and expelling sample liquid when the wheel is rolled in the opposite direction. In a preferred embodiment means are provided so that, near one end of its travel, the surface of the compression wheel departs from the support surface so that the resilient tubing can relax to its uncompressed state.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
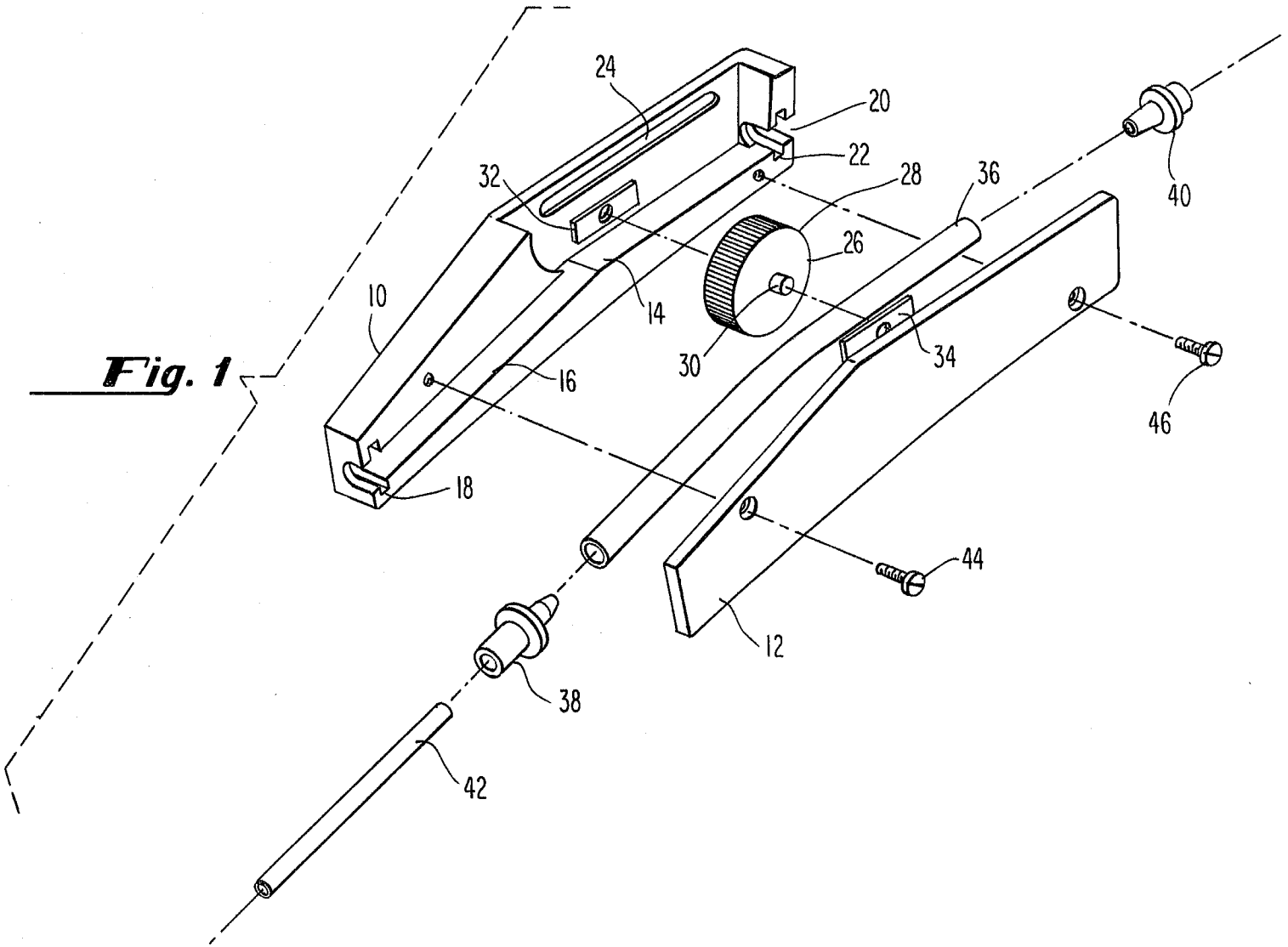
FIG. 1 is an exploded view of a pipetter formed in accordance with the invention.

The pipetter of FIG. 1 includes a housing comprising a first member 10 and a mating member 12. Member 10 defines a support surface 14 which is generally coextensive with the lower surface of an elongate channel 16 extending to a first end of the housing, wherein a groove 18 is formed about the channel. At the opposite end of the support surface is an opening generally designated 20, and a groove 22 in the opening wall.

Both members 10 and 12 are provided with guides, only guide 24 of member 10 being visible in the Figure. The guides extend generally parallel to the support surface 14, although the guide and the support surface diverge near one end thereof.

A compression member which takes the form of a wheel 26 has a series of serrations 28 about its periphery, and an axle 30 which protrudes from either side thereof. The protruding ends of the axle are received in sliders 32, 34 which ride in the guides of housing members 10 and 12, respectively.

Also disposed within the housing is an elongate, resilient tube 36. Hollow adapters 38, 40 are fitted into the first and second ends of the tube, respectively, each of the adapters being formed with an annular collar which is encaptured within grooves 18 and 20. Further, adapter 38 is formed so as to receive a sampling pipe such as capillary tube 42 in a tight-fitting relationship, whereby the capillary tube may be manually withdrawn from the adapter and replaced by another, unused tube. Finally, a pair of screws or the like 44, 46 are used to join the housing members together.

Figure 2:
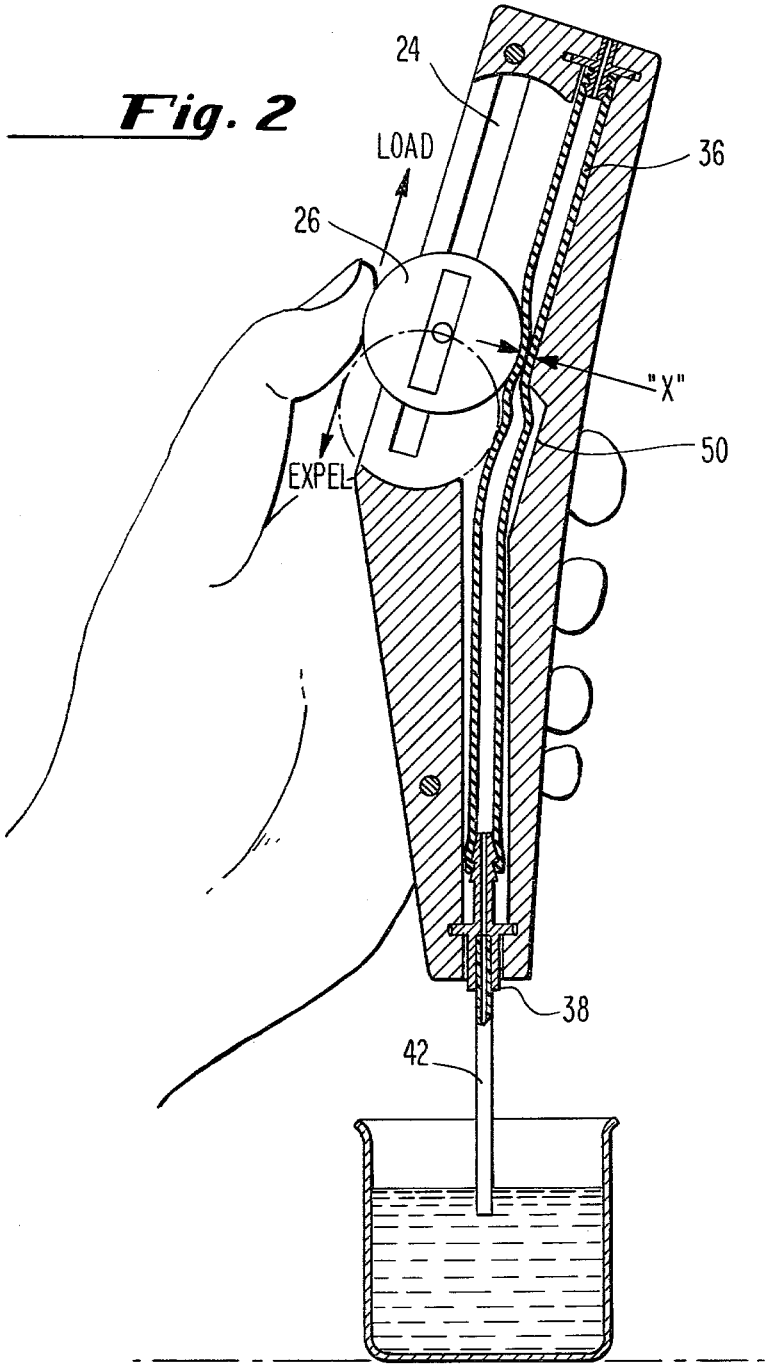
FIG. 2 is a sectioned view of the pipetter of FIG. 1, illustrating its operation.

Referring now to FIG. 2, the operation of a fully-assembled pipetter is illustrated. The sampling pipe 42 has been fitted into adapter 38 and, due to the relative size of the opening in the latter, is tightly held in place while in use. A passage extending through adapter 38 provides communication between interiors of sampling pipe 42 and flexible tube 36.

Although the material from which the flexible tube is made is not critical it must be of a resilient nature, and substantially inert in the presence of fumes or vapors from the liquids to be sampled. Natural rubber or silicone rubber have been found to perform well, and further are resistant to permanent deformation or "set" occasioned by the pressure of the compressing wheel 26. The materials of the other portions of the invention are similarly not of a critical nature and it has been found that plastics of the type used in injection molding serve well to form the adapters, compression wheel and body of the pipetter. The axle 30 which extends through the compressing member may advantageously be of steel; and in a preferred embodiment the sliders 32, 34 are formed of a material exhibiting a relatively low coefficient of friction, such as polytetrafluoroethylene.

In the embodiment of FIG. 2 the support surface is relieved to form a depression 50 lying generally beneath one end of guide 24. When not in use, the compression wheel 26 is moved to its lowermost position. The divergence of the support surface from the surface of the wheel provides sufficient room for tube 36 to relax to its original size so that the tubing may retain its open, generally circular configuration indefinitely when not in use. If desired, the guide 24 and cooperating slider 32 may be provided with a detent or the like, to hold the compression wheel in a "parked" position when the device is not in use.

In order to use the pipetter a sampling pipe, such as capillary tube 42, is urged into the open end of adapter 38. The compression wheel is rolled in a clockwise direction, following the path of guide 24. When the surface of the wheel reaches the end of depressed area 50 tube 36 is pinched closed. In this connection, it is important to note that the distance "X" between the periphery of the compression wheel and the support surface 14 must be less than twice the wall thickness of tube 36. This insures that the tube will be completely closed, and that peristaltic pumping action will take place. The distal end of the capillary tube is then submersed beneath the surface of a liquid to be sampled and compression wheel 26 urged further toward the top end of the pipetter, as indicated by the "Load" arrow of FIG. 2, until the desired volume is drawn into the capillary. The basic mode of operation of peristaltic pumps is well known; one example of such a device is disclosed in U.S. patent application Ser. No. 603,286, filed Aug. 11, 1975, by Lynn G. Amos.

As wheel 26 is rolled further the "pinch point" is continuously varied, moving upwardly and expelling air from the interior of tube 36 through adapter 40 as it travels. As will be recognized by those familiar with peristaltic pumps, after wheel 26 traverses a length of the tubing the tubing relaxes to its original position; since air has been expelled from that portion of the tubing, however, the pressure therein is lower than before, and the lowered pressure is communicated to sampling pipe 42 so that liquid is drawn into the latter.

The upward motion of compression wheel 26 is continued until the sampled liquid attains a desired height in pipe 42, which may be designated by a mark at an appropriate point upon the pipe surface. As soon as the compression wheel stops moving, liquid ceases to be drawn into the capillary tube; in other words, there is virtually no hysteresis involved. Accordingly an extremely precise, easily controllable volume of fluid can be loaded into the sampling pipe. The precision with which this can be accomplished is due in part to the fact that, for small volume increments, the operator's thumb moves approximately twice as far as does the pinch point of tube 36. This allows good manual control of the withdrawing and dispensing processes even by unpracticed operators.

When pipe 42 has been loaded with the requisite amount of sample, it is withdrawn from the sample liquid and the pipetter moved to the site of discharge, which may be another container, analytical apparatus, or the like. By grasping the pipetter as shown in FIG. 2 and rotating compression wheel 26 in a counterclockwise direction, so that it moves downwardly as indicated by the "expel" arrow, air within tube 36 is compressed and urges the liquid within the capillary tube outwardly. In this manner the liquid may be discharged either partially or completely, as the operator desires. By the time the compression wheel reaches the rightward edge of relieved area 50 the liquid is completely discharged, so that when tube 36 relaxes no sample material is left in the sampling pipe. The pipe may then be withdrawn from adapter 38 and the pipetter assembly stored or reused, as desired.

Figure 3:
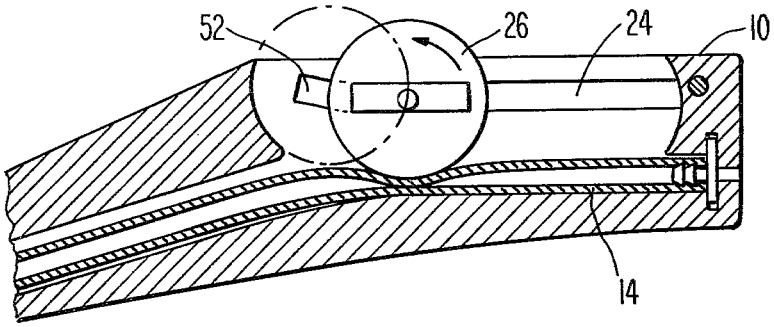
FIGS. 3 and 4 illustrate alternative manners of effecting the departure of a compression wheel from a support surface of the apparatus.

FIG. 3 illustrates another manner in which release of tube compression may be achieved, With this embodiment, guide 24 includes an upturned end section 52 at one end thereof. As compression wheel 26 moves to the left, slider 32 encounters the rising section of the guide and causes wheel 26 to move upwardly, away from the supporting surface 14 upon which the resilient tube rests. When wheel 26 has been moved to its full leftward position, the surface of the wheel is substantially clear of tube 36 so that the tube can relax to its uncompressed state.

Figure 4:
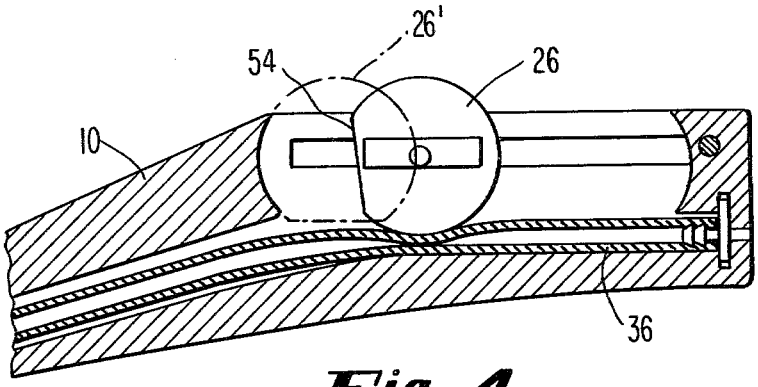

FIG. 4 illustrates another manner in which the foregoing result may be achieved. With this embodiment compression wheel 26, rather than being round, is eccentric; one area of the wheel has a reduced radius so that when that portion confronts tube 36, compression of the latter will cease. In the illustrated embodiment a flat 54 is formed at one side of the compression wheel. When the wheel is in its leftwardmost position, flat 54 extends generally parallel with the upper surface of tube 36, as shown, so that the tube is not compressed. As wheel 26 is rotated to the right, however, the leading edge of flat 54 encounters the surface of the tube and the wheel commences to pinch the tube closed, as before. So long as the length of the full-size periphery of wheel 26 is longer than the expected length of travel, flat 54 will not again confront the tube as the wheel is moved to the right. After the sampling pipe is filled in the usual manner, wheel 26 may be rotated to the left to discharge the sample tube as before. Further rotation of wheel 26 will translate it to its leftwardmost position 26' in which resilient tube 36 will be released.

Figure 5:
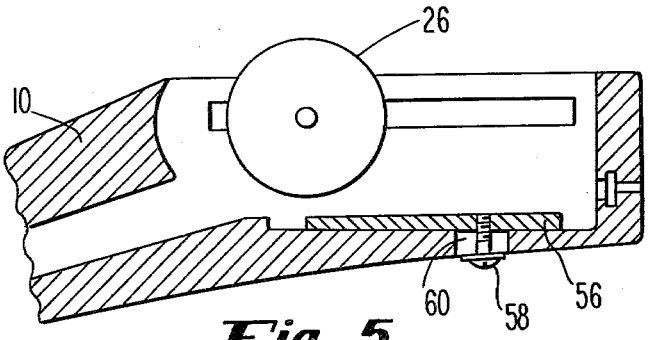
FIGS. 5 and 6 represent adjustable embodiments of the invention.

It will now be recognized that the dimension between the supporting surface 14 and confronting periphery of wheel 26 is critical to the operation of the invention, and must be closely controlled. However the more economical methods of manufacture, such as injection molding processes, may not allow the necessary close tolerances to be achieved. Accordingly, and as shown in FIG. 5, the support surface may be made adjustable by means of a wedge 56 which is held against the lower portion of housing 10 by means of a screw 58 or the like. The screw is threaded into wedge 56, and extends through a slot 60 in the bottom of the housing to allow the necessary degree of longitudinal adjustment.

Figure 6:
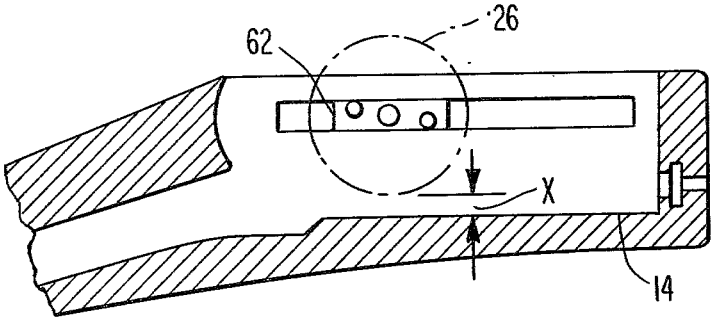

FIG. 6 illustrates still another means by which the distance between wheel 26 and support surface 14 may be achieved. Slider 62 is provided with a plurality of apertures for receiving the axle of the compressing wheel. Each of the apertures is located at a slightly different height in the slider, and the axle simply assembled in the aperture which will provide the requisite dimension "X" for completely pinching the resilient tube closed. By locating the apertures asymmetrically with respect to the horizontal centerline of the slider, the number of possible axle locations can be doubled by simply turning the slider upside down. An additional advantage of this embodiment is that one housing body may accommodate a variety of tube thicknesses that may be encountered in changing the capacity of the unit by changing the size of the flexible tube. In this manner the capacity can be changed, for example, from 1 to 10 micro-liters.

It will now be understood that there has been disclosed herein an improved pipetter of the hand-held variety, which exhibits little or no hysteresis in operation, and may be economically manufactured. As will be evident from the foregoing description, certain aspects of the invention are not limited to the particular details of the examples illustrated, and it is contemplated that other modifications or applications will occur to those skilled in the art. For example, the supporting surface 14 need not be perfectly flat, but may be crowned somewhat to allow for the "dumb-bell" cross-sectional shape of the resilient tube, when collapsed. In the same manner, the perimeter of compression wheel 26 need not be perfectly flat, but may be convex, concave, or provided with various types of irregular surfaces to enhance the gripping and compression of the resilient tube. It is accordingly intended that the appended claims shall cover all such modifications and applications as do not depart from the true spirit and scope of the invention.

What is claimed as new and desired to be secured by Letters Patent of the United States is:

1. A pipetter for controllably drawing a volume of fluid from a supply into a capillary tube, comprising:

a housing having a first and a second end and a support surface extending therebetween;

a resilient tube disposed in said housing and extending over said support surface;

adapter means for replaceably receiving a sampling pipe to be filled with a fluid, said adapter means defining a passage for coupling the interior of the sampling pipe with the interior of said tube;

compression wheel means for compressing said tube against said support surface at a point intermediate the ends thereof, said compression wheel means being adapted to be moved with respect to said support surface by the user of the pipetter;

mounting means in said housing for guiding said compression wheel means in a direction generally parallel to said support surface;

whereby the point at which said tube is compressed may be continuously varied to create a lowered pressure in said adapter passage; and means to preclude substantial compression of said tube at one position of said wheel, whereby said tube relaxes to its uncompressed state when said wheel is in said position.

2. A pipetter according to claim 1, wherein said mounting means and said support surface diverge near one of the ends thereof.

3. A pipetter according to claim 2, wherein said mounting means defines a generally linear path for said compression wheel means, and said support surface diverges from said path near one end thereof.

4. A pipetter according to claim 3, wherein said compression wheel means comprises a rotatable disk.

5. A pipetter according to claim 4, further including axle means extending from either side of said disk; an elongate groove formed in said housing; and a slider having an aperture receiving said axle means and disposed in said groove for movement therealong.

6. A pipetter according to claim 1, wherein said compression wheel is sufficiently eccentric to preclude substantial compression of said tube at one position of said wheel.

7. A pipetter for withdrawing a controlled volume of fluid from a supply into a sampling pipe, comprising:

a housing defining a generally rigid support surface, and an elongate guideway extending generally parallel thereto;

a resilient tube disposed within said housing and overlying said support surface;

means coupled to one end of said tube and adapted to receive a sampling pipe to be filled with fluid; said means defining a passage for coupling the interior of said sampling tube with the interior of said resilient tube; and a compression wheel having an axle means retained in said guideway and having a sufficient radius to compress said resilient tube against said support surface when said axle means is disposed at a predetermined point along said guideway, and being sufficiently eccentric to prevent said compression of said resilient tube at one position of said wheel.

8. A pipetter according to claim 7, wherein said rigid support surface diverges from said guideway near one end thereof, whereby when said compression wheel is disposed near one end of said guideway said resilient tubing is not substantially compressed.

9. A pipetter according to claim 8, further including an axle extending through said compression wheel, and a slider disposed in said guideway for receiving said axle means.

10. A pipetter according to claim 8, further including means for adjusting the relative spacing between said rigid support surface and said guideway.

11. A pipetter according to claim 8, further including a second adapter engaging the second end of said resilient tube and defining a passage for venting said resilient tube to the atmosphere.

12. A pipetter according to claim 9, wherein said slider is provided with at least two apertures disposed at different distances from said support surface for allowing said compression wheel to be selectively spaced by at least two different distances from said support surface.

* * * * *